US006605402B2

(12) United States Patent
Schein et al.

(10) Patent No.: US 6,605,402 B2
(45) Date of Patent: Aug. 12, 2003

(54) METHOD OF USING VARIABLY SIZED COATING PARTICLES IN A MONO COMPONENT DEVELOPING SYSTEM

(75) Inventors: Lawrence B Schein, San Jose, CA (US); Graham Galliford, Ventura, CA (US); Taomo Mu, Shin-Dian (TW)

(73) Assignee: Aetas Technology, Incorporated, Irvine, CA (US)

( * ) Notice: Subject to any disclaimer, the term of this patent is extended or adjusted under 35 U.S.C. 154(b) by 0 days.

(21) Appl. No.: 09/934,065

(22) Filed: Aug. 21, 2001

(65) Prior Publication Data

US 2003/0077535 A1 Apr. 24, 2003

(51) Int. Cl.[7] ..... G03G 9/00

(52) U.S. Cl. ..... 430/108.7; 430/108.6; 399/252

(58) Field of Search ..... 430/108.7, 108.6; 399/252

(56) References Cited

U.S. PATENT DOCUMENTS

| | | | | |
|---|---|---|---|---|
| 3,166,432 | A | | 1/1965 | Gundlach |
| 3,627,682 | A | | 12/1971 | Hall, Jr. et al. |
| 3,720,617 | A | | 3/1973 | Chatterji et al. |
| 3,939,087 | A | | 2/1976 | Vijayendran et al. |
| 4,067,295 | A | | 1/1978 | Parker et al. |
| 4,233,382 | A | | 11/1980 | Edwards et al. |
| 4,296,192 | A | | 10/1981 | Gruber et al. |
| 4,608,328 | A | | 8/1986 | Schwarz et al. |
| 4,618,556 | A | | 10/1986 | Takenouchi |
| 4,680,245 | A | | 7/1987 | Suematsu et al. |
| 4,699,865 | A | | 10/1987 | Mitsuhashi |
| 4,845,004 | A | | 7/1989 | Kobayashi |
| 4,906,548 | A | | 3/1990 | Uchide et al. |
| 5,041,351 | A | | 8/1991 | Kitamori et al. |
| 5,066,558 | A | | 11/1991 | Hikake et al. |
| 5,143,811 | A | | 9/1992 | Itakura et al. |
| 5,212,037 | A | | 5/1993 | Julien et al. |
| 5,215,845 | A | | 6/1993 | Yusa et al. |
| 5,307,122 | A | | 4/1994 | Ohno et al. |
| 5,312,711 | A | | 5/1994 | Tavernier et al. |
| 5,534,981 | A | | 7/1996 | Ohno et al. |
| 5,547,796 | A | | 8/1996 | Kohtaki et al. |
| 5,620,823 | A | * | 4/1997 | Kambayashi et al. ..... 430/102 |
| 5,633,108 | A | | 5/1997 | Christy et al. |
| 5,691,097 | A | | 11/1997 | Bortfeldt |
| 5,804,351 | A | * | 9/1998 | Takano et al. ..... 430/108.1 |
| 5,925,446 | A | | 7/1999 | Matsuda et al. |
| 6,025,106 | A | * | 2/2000 | Azuma et al. ..... 430/108.7 |
| 6,087,056 | A | | 7/2000 | Toyoshima et al. |
| 6,117,607 | A | * | 9/2000 | Shimizu et al. ..... 430/108.7 |
| 6,287,739 | B1 | * | 9/2001 | Kawakami et al. ..... 399/222 |
| 6,298,211 | B1 | * | 10/2001 | Stockman et al. ..... 399/285 |
| 6,338,929 | B1 | * | 1/2002 | Hagi et al. ..... 430/108.4 |

* cited by examiner

*Primary Examiner*—Mark A. Chapman
(74) *Attorney, Agent, or Firm*—Sonnenschein Nath & Rosenthal

(57) ABSTRACT

The present invention is directed to a non-contact, single-component developing system for electrophotographic machines that effectively reduces the impact of adhesion forces on the development process. The developing system of the present invention utilizes a single-component toner that tends to reduce the adhesion forces that hold the toner particles on a toner support member. Preferably, the toner is combined with large and small silica particles having a concentration by weight that results in an optimum surface coverage of toner particles by large and small silica particles that facilitates a reduction in the adhesion forces holding the toner particles on the toner support member.

27 Claims, 13 Drawing Sheets

METHOD OF USING VARIABLY SIZED COATING PARTICLES IN A MONO COMPONENT DEVELOPING SYSTEM

FIELD OF THE INVENTION

The present invention relates generally to electrophotography, more particularly, to a non-contact, single-component developing system and single-component toner that facilitates efficient development of an electrostatic image and consistent high quality image output.

BACKGROUND OF THE INVENTION

Electrophotographic imaging process (or xerography) is a well-known method of copying or otherwise printing documents. In general, electrophotographic imaging uses a charge-retentive, photosensitive surface (known as a photoreceptor) that is initially charged uniformly. The photoreceptor is then exposed to a light image representation of a desired image that discharges specific areas of the photoreceptor surface creating a latent image. Toner powder is applied by using a developing system, which carries the toner from a toner container to the latent image, forming a developed image. This developed image is then transferred from the photoreceptor to a substrate (e.g. paper, transparency, and the like).

A color electrophotographic imaging process is typically achieved by repeating the same process described above for each color or tone of toner desired and storing each developed image to an accumulator until all desired colors or tones are achieved and then transferred to a substrate (e.g. paper, transparency, and the like).

There are several developing systems known in the art that carry the toner to the developing region and develop the latent image. One process is known as a "non-contact" or "jump" developing system. In operation, a thin layer of toner is adhered to a toner support member in spaced relation with respect to the latent image-bearing surface of the photoreceptor. When the toner is carried to the developing region between the toner support member and the photoreceptor, a bias voltage associated with the latent image areas of the photoreceptor tends to exert electrostatic forces that direct the toner particles towards the latent image areas on the surface of the photoreceptor. The electrostatic forces are often of insufficient magnitude to overcome the adhesion forces holding the toner particles in the thin layer on the toner support member. One solution is to apply high AC voltage to the developing region. The AC voltage agitates the toner particles to free them from the toner support member, enabling the toner particles to "jump" the gap between the toner support member and the photoreceptor. The toner particles that jump the gap adhere to the latent image areas on the surface of the photoreceptor to form a developed image. For color or "tone-on-tone" developing, this process is repeated and the developed images containing individual colors are transferred to and stored on an accumulator until all desired colors or tones are achieved and than transferred to a substrate (e.g. paper, transparency, and the like). Although this process will produce color and tone-on-tone images with sufficient efficiency, the addition of an accumulator increases the complexity and cost of the electrophotographic imaging system.

Although previous efforts have been made to produce a non-contact developing system for multi-color imaging utilizing a single component toner and accumulation of the image on a single photoconductor (i.e., no accumulator), none of these efforts appear to have resulted in a system that effectively develops color toner particles to a photoreceptor with sufficient efficiency.

Also, previous efforts have been made to produce a non-contact developing system for monochrome imaging utilizing a single component toner and using DC bias only. None of these efforts appear to have resulted in a system that effectively develops toner particles to a photoreceptor with sufficient efficiency.

SUMMARY OF THE INVENTION

The present invention is directed to a non-contact, single-component developing system for electrophotographic machines that effectively reduces the impact of toner adhesion forces on the development process and facilitates toner jump while eliminating the need for AC voltages and, thus, an accumulator or some other intermediate transfer member. In a particularly innovative aspect, the developing system of the present invention utilizes a single-component toner that tends to reduce adhesion forces that tend to adhere toner particles to a toner support member. More particularly, the toner in accordance with the present invention includes large and small extraparticulate particles having concentrations by weight that preferably optimize surface coverage of the toner particles by the extraparticulate particles. In referring to surface coverage by area (surface coverage, surface coverage area), the total area of toner surface=$\pi D_T^2$ and the projected area of silica=$D_{si}^2$, as shown in FIG. 14. The extraparticulate particles of the present invention are preferably comprised of silica particles but may be comprised of an extraparticulate with similar physical characteristics to silica including material such as titanium dioxide, polymer microspheres, polymer beads, cerium oxide, zinc stearate, alumnina, and the like. In a preferred embodiment, surface coverage of toner particles by large extraparticulate particles is in a range of about 5 to 50 percent and surface coverage of toner particles by small extraparticulate particles is in a range of about 50 to 150 percent.

A toner may be prepared with the required calculated surface area coverage of extraparticulate particles by incorporation of a specific weight percent of each of the large and small extraparticulate particles by taking into account the mean diameter of the toner, the specific gravity of the toner and mean diameters and densities of each of the large and small extraparticulate particles. For example, for a 12 $\mu$ mean diameter toner with specific gravity of 1.1 g/cm$^3$ combined with large extraparticulate particles having a mean diameter of 40 nm and a specific gravity of 2.2 g/cm$^3$ and small extraparticulate having a mean diameter of 10 nm and specific gravity of 2.2 g/cm$^3$, the surface area coverage of the large extraparticulate of 5 to 50 percent corresponds to a concentration by weight of 0.16 percent to 1.6 percent and the surface area coverage of the small extraparticulate of 50 to 150 percent corresponds to a concentration by weight of 0.45 to 1.35 percent.

In a further innovative aspect, the toner in accordance with the present invention has a development efficiency in a range of about 80 to 99 percent over a wide range of bias voltages.

In a preferred embodiment, a development system of the present invention preferably comprises a toner support member and a photoreceptor positioned in spaced relation. In operation, the photoreceptor is initially charged uniformly and then exposed to a light image representative of a desired image that discharges specific areas of the image bearing surface of the photoreceptor. Toner, which is carried to the developing region by the toner support member, is caused to jump the gap between the toner support member and the photoreceptor to the latent image, forming a developed image. Significantly, the electrostatic forces resulting from the DC bias voltage are sufficient to overcome toner adhesion forces without the use of AC voltages or some other means of freeing the toner free from the toner support member. This advantageously enables the development of color or "tone-on-tone" images without the need for an accumulator or some other intermediate transfer member.

Other innovative aspects of the invention include the preceding aspects individually or in combination.

Other aspects and features of the present invention will become apparent from consideration of the following description taken in conjunction with the accompanying drawings.

DETAILED DESCRIPTION OF PREFERRED EMBODIMENTS

The non-contact, single-component developing system of the present invention tends to facilitate efficient development of an electrostatic image and the consistent production of high quality output images. More particularly, the system of the present invention tends to reduce adhesion forces that hold toner particles to a toner support member to enable toner particles to more easily and efficiently jump from the toner support member to an image-bearing member such as a photoreceptor.

Figure 1:
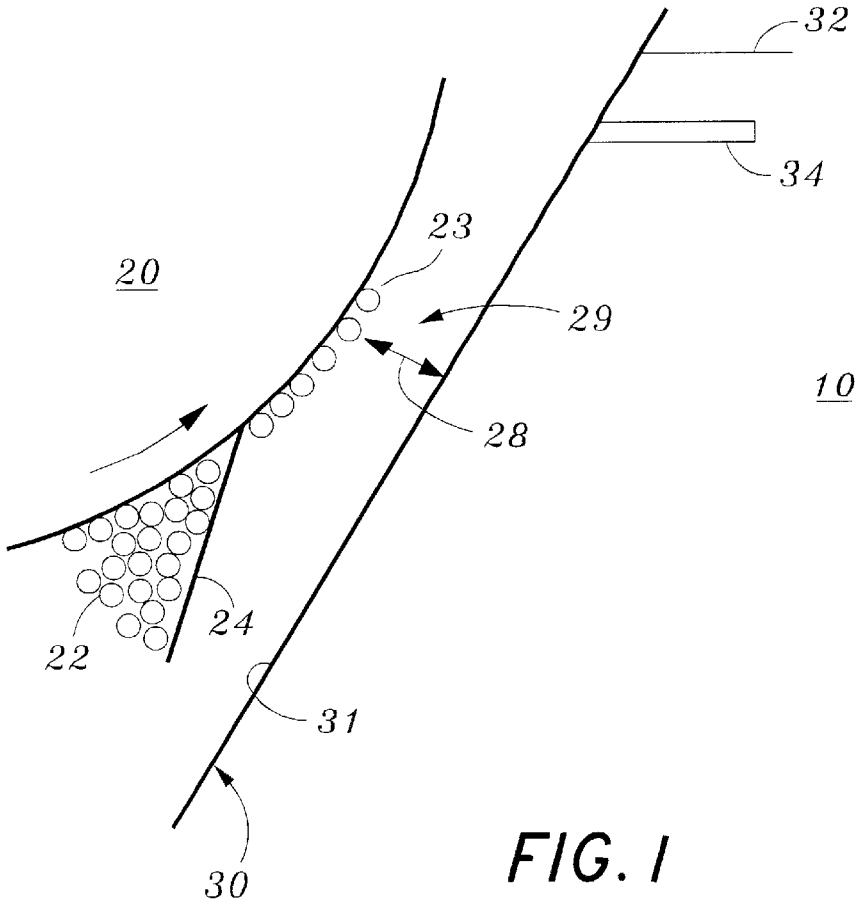
FIG. 1 is a schematic of a non-contact, single-component developing system of the present invention.

Referring in detail to the figures, FIG. 1 shows a non-contact or jump developing system 10 for use with a single-component toner in accordance with the present invention. The developing system 10 preferably includes a toner support member 20, such as a roller, and a photoreceptor 30, such as a photosensitive drum or belt. The toner roller 20 and photoreceptor 30 are aligned in spaced relation to form a gap 28 at the "developing region" 29. Preferably, the gap 28 is approximately 150 microns. A metering bar 24 contacts the toner roller 20 and acts to create a thin layer and to charge the toner particles 22 on the toner support member 20 from a toner reservoir or supply. The developing system 10 also includes an electrically coupled charger element 32 and an array of light emitting diodes (LEDs) 34.

In operation, the surface 31 of the photoreceptor 30 is initially uniformly charged by the charger element 32 to a potential preferably in the range of approximately −700 to −750 V (DC). The photoreceptor 30 is constructed of a material that is conductive (i.e., allows a charge to dissipate) only when exposed to light. To create the desired electrostatic latent image on the photoreceptor 30, light is radiated from the arrays of LEDs 34 onto the surface 31 of the photoreceptor 30 to dissipate the charge on the surface 31 in a pattern to form a latent image corresponding to a desired image. After exposure of the photoreceptor 30 to light the potential of the latent image areas on the photoreceptor 30 is reduced to a range of approximately −50 V (DC).

The toner roller 20 is preferably biased to a potential approximately equal to the potential of the non-image areas on the image-bearing surface 31, but between the potential of the image and non-image areas. Preferably, the potential of the toner support member has a value of approximately the same as the non-image areas.

As the toner roller 20 carries the toner 22 into the developing region 29, the difference between the bias voltage on the toner roller and the potential difference associated with the latent electrostatic image areas on the surface 31 of the photoreceptor 30, which is approximately 650 V (DC), preferably exerts a force of sufficient magnitude on the toner particles 22 to cause the toner particles 22 to jump the gap 28 between the toner roller 20 and the photoreceptor 30 and adhere to the latent electrostatic image areas on the surface 31 of the photoreceptor 30. The voltage difference between the non-image areas of the surface 31 and the toner support member which is approximately zero V (DC), tends to exert zero force on the toner particles on the toner support member 20.

Figure 2:
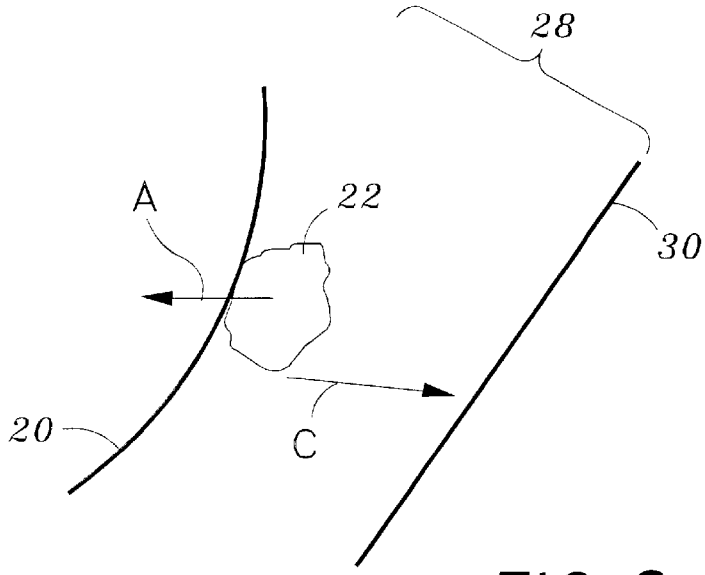
FIG. 2 is a schematic illustrating the forces acting upon a toner particle during the development process.

As shown in FIG. 2, for toner particles 22 to jump the gap 28 during the development process, the electrostatic, or Coulombic, force C acting upon the toner particle 22 must be sufficient to overcome the adhesion force A that adheres the toner particle 22 to the toner roller 20. If not, development efficiency and, thus, image quality tend to suffer. To reduce the impact of the adhesion forces, conventional methods tend to include the use of AC voltage or some other means of agitating the toner. Significantly, as discussed in greater detail below, the toner in the development system of the present invention advantageously reduces the impact of adhesion forces on the development process without resort to AC voltage or other means to agitate the toner. This tends to be of particular significance with regard to color or "tone-on-tone" developing because it enables the simplification and reduction in size and, thus, cost of the development system by eliminating the need for an accumulator or some other intermediate transfer means.

Figure 3A:
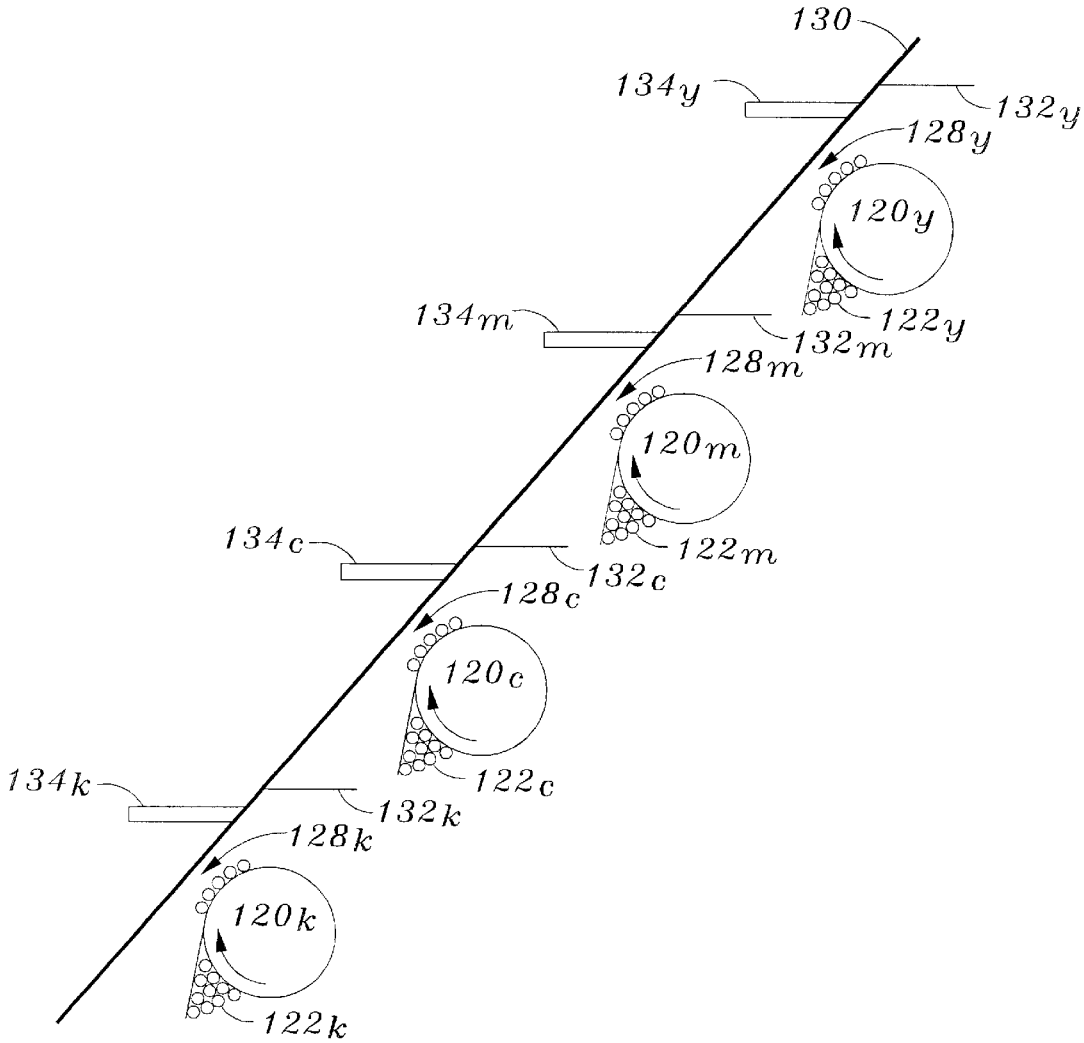
FIG. 3*a* is a schematic of a non-contact, single-component color developing system in accordance with the present invention.

Turning to FIG. 3*a*, a non-contact, single-component color or "tone-on-tone" developing system 100 in accordance with the present invention is shown to preferably include a photoreceptor, e.g., an image-bearing belt 130, and four toner support members 120*y*, 120*m*, 120*c*, and 120*k* for delivery of toners preferably comprising toner of four different color pigments. The toner support members 120*y*, 120*m*, 120*c*, and 120*k*, respectively, preferably deliver yellow toner particles 122*y*, magenta toner particles 122*m*, cyan toner particles 122*c*, and black toner particles 122*k* to the developing region 128*y*, 128*m*, 128*c*, and 128*k* interposing the toner support members 120*y*, 120*m*, 120*c*, and 120*k* and the image-bearing belt 130. The developing system 100 preferably includes four charger elements 132*y*, 132m, 132*c*, and 132*k*, respectively, and four LED arrays 134*y*, 134*m*, 134*c*, and 134*k*, respectively, positioned along the belt 130 prior to a corresponding toner support members 120*y*, 120*m*, 120*c*, and 120*k*. By including four charger elements and four LED arrays, the developing system 100 of the present invention is preferably capable of developing a color image in a single pass of the photoreceptor 130. Alternatively, the developing system 100 may include two charger elements and two LED arrays to enable a color image to be developed in two passes of the photoreceptor 130, or one charge and one LED array to enable a color image to be developed in four passes of the photoreceptor 130.

Figure 3B:
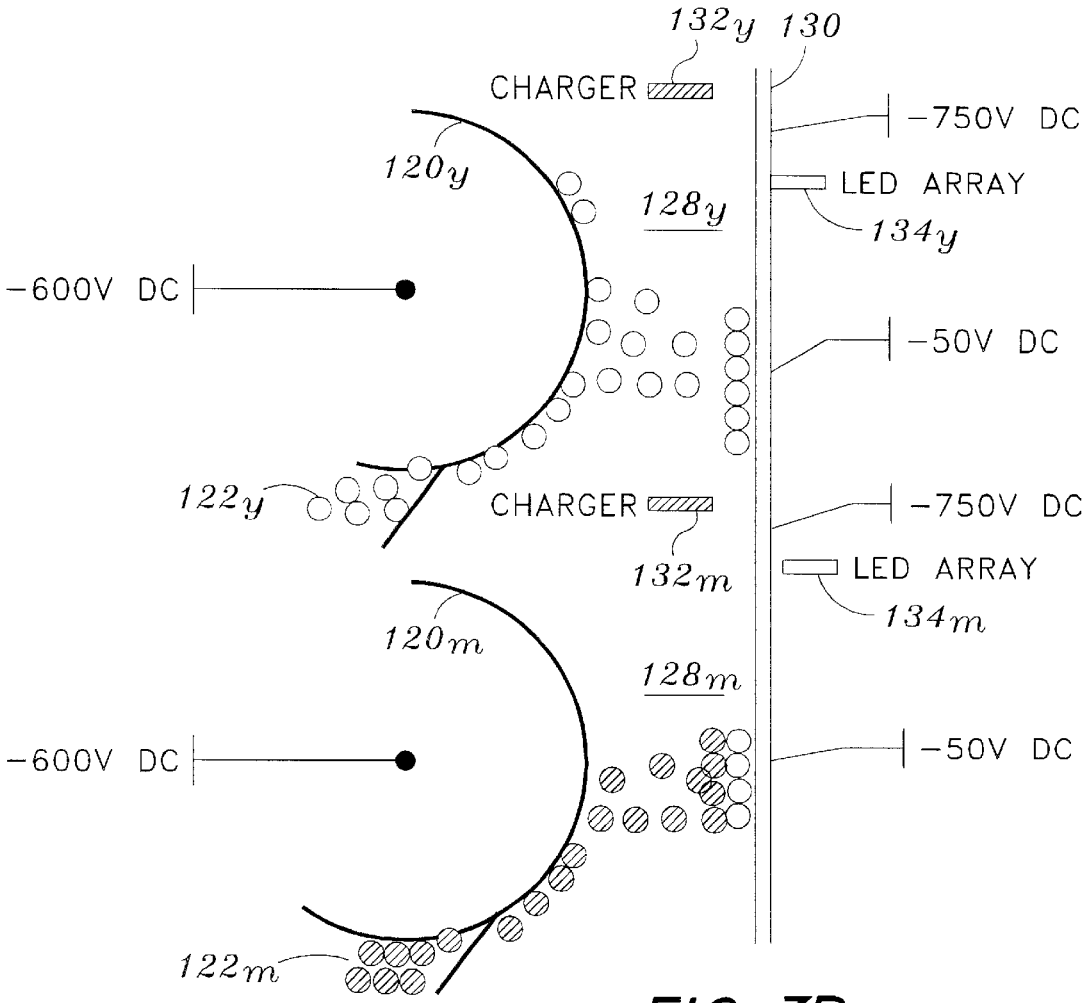
FIG. 3*b* is a partial schematic of the non-contact, single-component color developing system shown in FIG. 3*a*.

In operation, as shown in greater detail in FIG. 3*b*, the first charger element 132*y* initially uniformly charges the image-bearing belt 130 to a potential in the range of approximately −700 V (DC) to −750 V (DC). Next, the first LED array 134*y* radiates light onto the image-bearing belt 130 in a specific pattern corresponding to portions of a desired image that require the inclusion of the color yellow. The charge on the areas of the belt 130 exposed to the light dissipates to a potential of approximately −50 V (DC). After the image-bearing belt 130 passes the first developing region 128*y* adjacent the first toner support member 120*y* where toner is directed to the latent electrostatic areas along the surface of the belt, the belt 130 is again uniformly-charged to a potential in the range of approximately −700 V (DC) to −750 V (DC) by the second charger element 132*m*. Light is then radiated from the second LED array 134*m* onto the belt 130 in a specific pattern corresponding to portions of a desired image that require the inclusion of the color magenta, including portions that already have yellow toner deposited thereon. The charge on portions of the belt 130 that do not already have toner deposited thereon dissipates, causing those portions of the belt 130 to have a potential of approximately −50 V (DC); however, the charge on portions of the belt 130 that already have toner deposited thereon tends to dissipate less, causing those portions of the belt 130 to have a potential in a range of approximately −150 V to −250 V (DC). After the image-bearing belt 130 passes the second developing region 128*m* adjacent the second toner support member 120*m* where toner is directed to the latent electrostatic areas along the surface of the belt, the process is repeated for the two remaining colors (e.g., cyan and black).

Because the charge on portions of the belt 130 already having toner deposited thereon may only dissipate to a potential of approximately −150 V to −250 V (DC), the voltage difference applied to the toner particles to cause the toner particles to jump the gap 128 and adhere to these portions of the belt 130 is significantly reduced to approximately 450 V to 600 V (DC). The reduction in the voltage difference results in a reduction of the electrostatic forces acting on the toner particles. As described more fully below, the present invention effectively reduces the impact of adhesion forces on the development process advantageously over a wide range of bias voltages. As a result, development efficiency and, thus, image quality tend to be enhanced.

Figure 4:
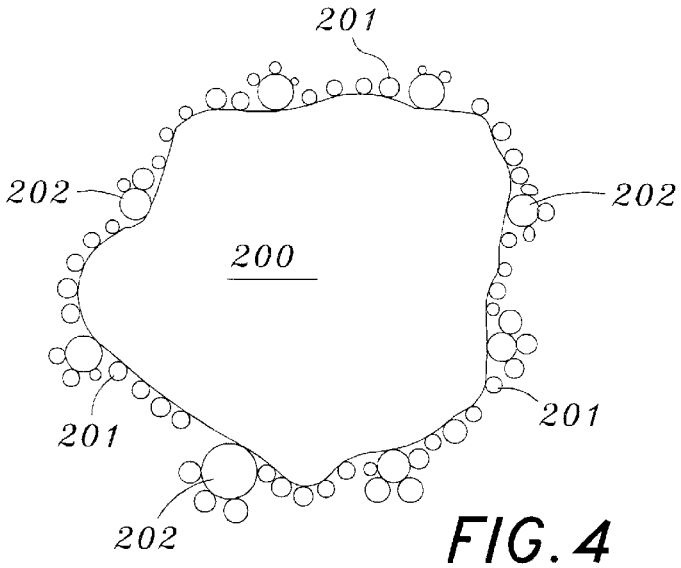
FIG. 4 is a plan view of a toner particle with silica particles adhered thereto.

Referring back to FIG. 2, the adhesion force A tends to be distributed over and directly proportional to the size of a contact area between the toner particle 22. Thus, the larger the contact area between the toner particle 22 and the toner roller 20, the greater the magnitude of the adhesion force A. Accordingly, the present invention effectively reduces the negative impact of adhesion forces on the development process by altering or manipulating the formulation of extraparticulate particles in a toner to reduce the contact area between the toner particles 22 and the toner support member 20. As shown in FIG. 4, large and small extraparticulate particles 202 and 201, which are mixed with toner particles such that they are well dispersed onto the surface of the toner particles, 200 in a manner known in the art, adhere to the surface of a toner particle 200. The extraparticulate particles 202, 201 provide much smaller contact points with the toner support member 20, thus reducing the adhesion force between the toner particle 200 and the toner support member 20.

Figure 5:
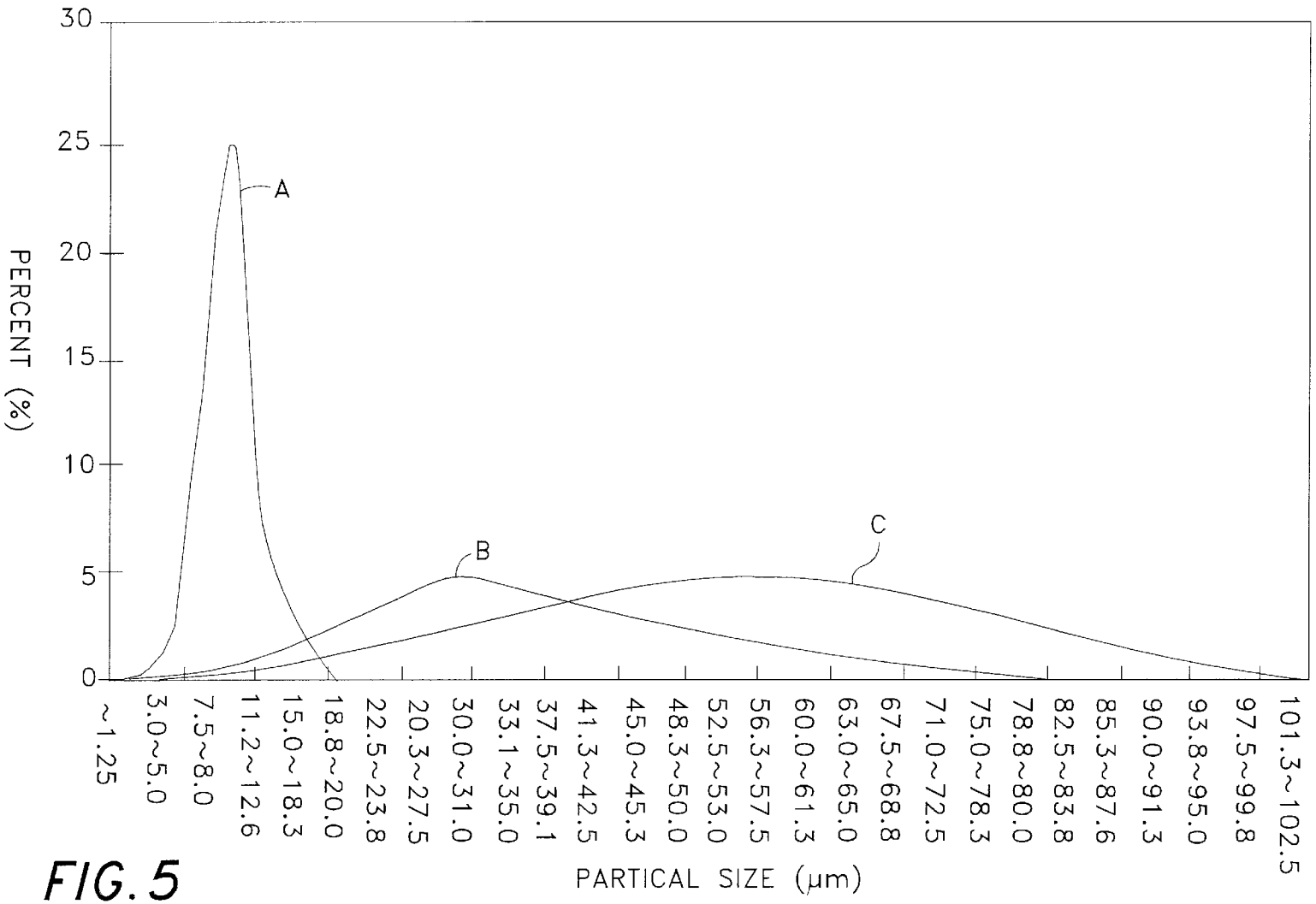
FIG. 5 is a graph showing a typical particle size distribution for silica.

Extraparticulate particles such as silica are commonly combined with toner particles in electrophotographic machines to improve the flowability and durability of the toner. The large particles of silica 202, which are typically in the range of approximately 20–50 nm in diameter, are typically mixed with toner particles 200. The small particles of silica 201, which are typically in the range of 6–12 nm in diameter, are typically mixed with toner particles 200 to improve or enhance the flowability of the toner particles. The graph in FIG. 5 shows a typical particle size distribution for silica particles with mean diameters of approximately 10 nm (curve A), 30 nm (curve B) and 40 nm (curve C).

In a preferred embodiment, a single-component toner of the present invention preferably combines extraparticulate particles with toner particles. Alternatively, particles of extraparticulates such as titanium dioxide, polymer microspheres, polymer beads, cerium oxide, zinc stearate, alumina, and the like, may be combined with the toner particles and produce the same result. The silica particles are preferably formed from fumed silica in a manner known in the art and include both large and small silica particles 202, 201 of sizes in the ranges discussed above. The toner particles 200 may be formed from a variety of formulations known in the art. The concentration by weight of the small silica particles 201 and large silica particles 202 relative to the toner particles 200 is preferably manipulated to optimize the coverage of toner particle surface area by the silica particles. Referring to FIG. 4, the surface coverage of the toner particle 200 by large silica particles is preferably in a range of about 5 to 50 percent, and most preferably about 15 percent, while the surface coverage of the toner particle 200 by small silica particles 201 is preferably in a range of about 50 to 150 percent, and most preferably about 100 percent surface coverage. As shown in FIG. 4, a surface coverage greater than 100 percent is realizable because the small silica particles tend to adhere to both the toner particle 200 and the large silica particles 202.

Figure 14:
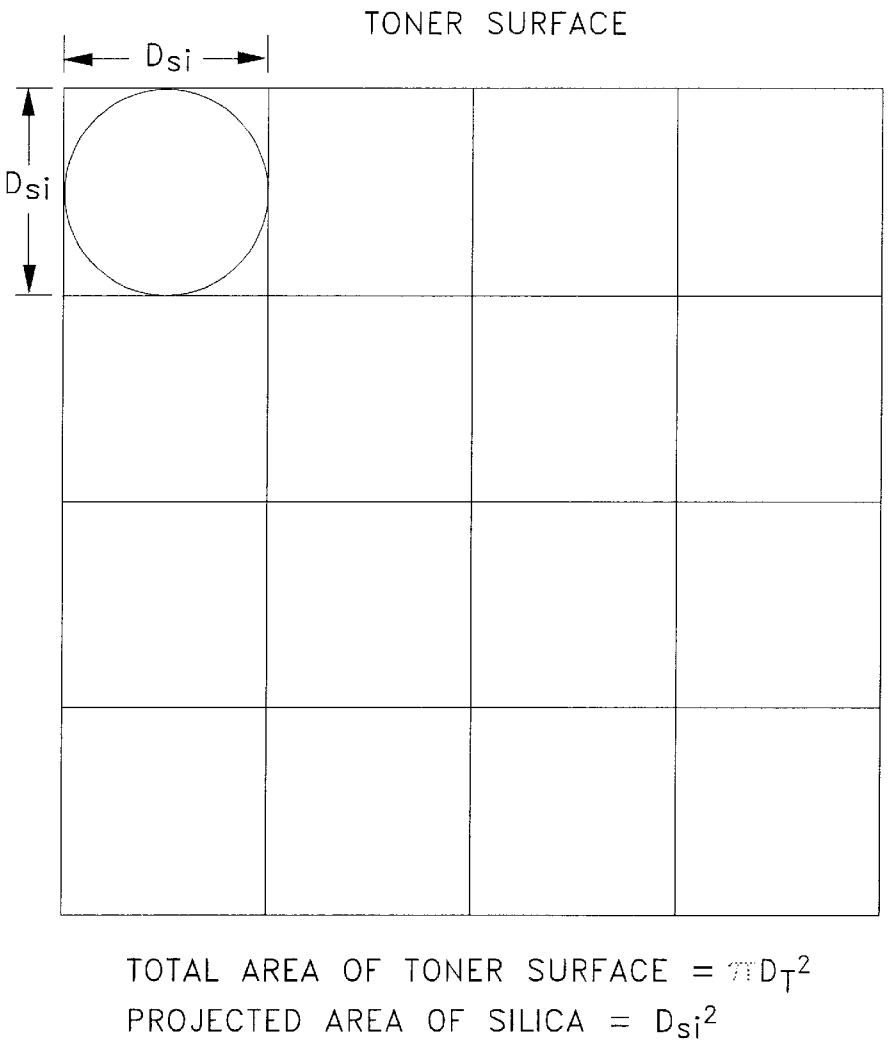
FIG. 14 is a schematic illustrating the calculated surface area coverage.

The relationship between silica concentration by weight and toner surface coverage is provided by the following equations:

where $$C_m = n_{Si}\rho_{Si}(D_{Si})^3/\rho_T(D_T)^3$$

and $$S_c = (1/\pi)n_{Si}(D_{Si})^2/(D_T)^2$$

Where the percent surface coverage ($S_c$) is defined as the number of silica particles ($n_{Si}$) times their projected area $(D_{Si})^2$ divided by the area of a spherical toner particle $\pi(D_T)^2$, as shown in FIG. 14.

The equation, $$S_c = (C_m/\pi)(\rho_T/\rho_{Si})(D_T/D_{Si})$$

describes the surface coverage for single sized spherical particles. To take into account non-spherical particles, size distributions, and agglomerations this equation should be modified by adding an empirically obtained term beta=0.6 to the above equation. Therefore $$S_c=(\beta_{Cm}/\pi)(\rho_T/\rho_{Si})\ (D_T/D_{Si})$$

$C_m$ is the calculated concentration by weight of silica particles relative to toner particles;

$S_c$ is the percentage of surface coverage of the toner particle by silica particles;

$n_{Si}$ is the mean number of silica particles;

$\rho_{Si}$ is the specific gravity of silica (2.2);

$D_{Si}$ is the mean diameter of the silica particles (nm);

$\rho_T$ is the specific gravity of a toner particle (1.1); and $D_T$ is the mean diameter of the toner particles ($\mu$m).

Tables 1 below provide the corresponding values of silica concentration and surface coverage for small and large silica particles.

TABLE 1

| Toner Diameter ($\mu$) | Silica Diameter (nm) | Concentration (%) | $S_c$ (%) |
|---|---|---|---|
| 12 | 10 | 0.9 | 100 |
| 12 | 40 | 0.5 | 14 |
| 16 | 10 | 0.7 | 93 |
| 16 | 40 | 0.4 | 15 |

Figure 6:
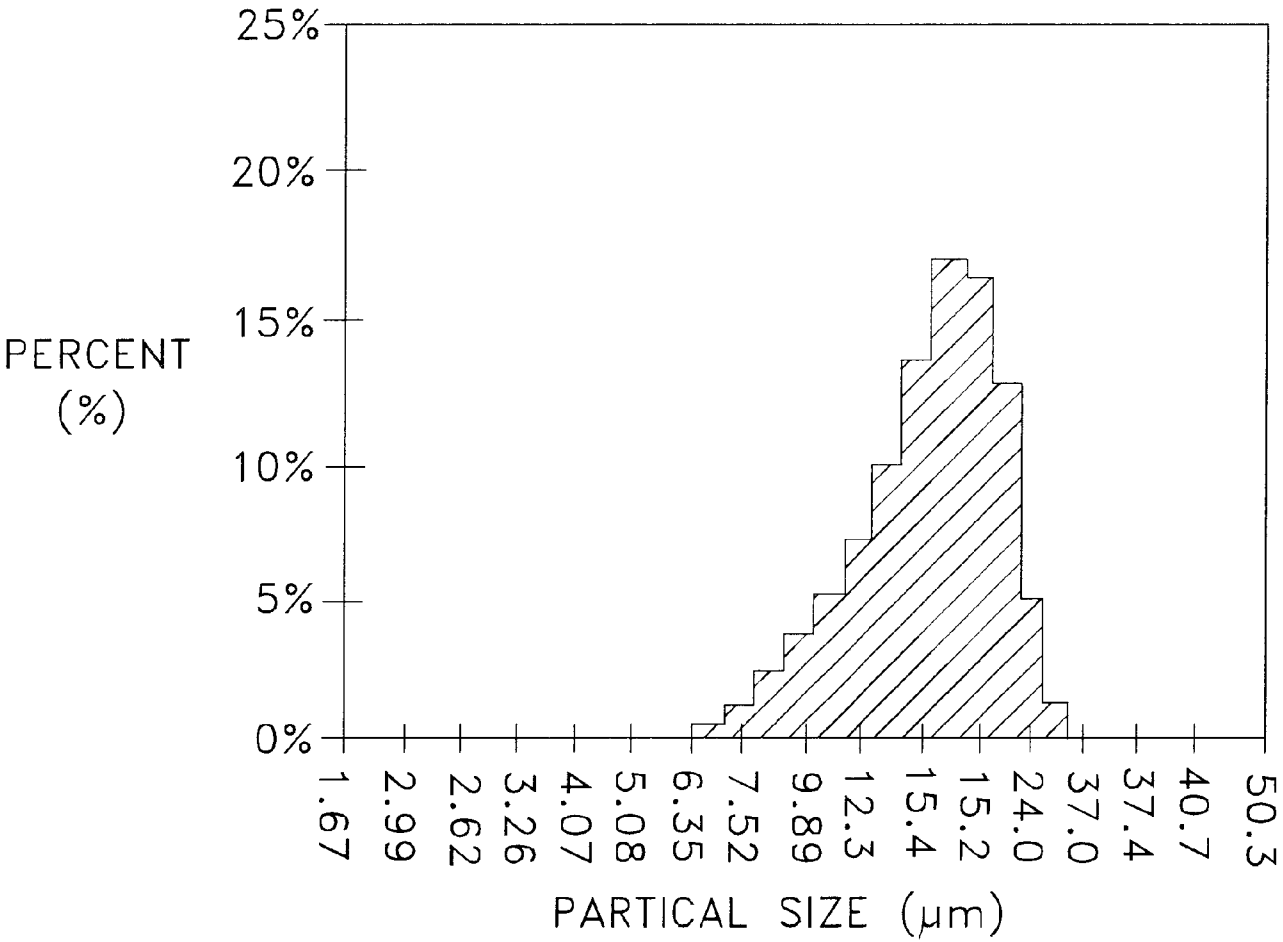
FIG. 6 is a graph showing a typical particle size distribution for toner particles having a mean diameter of 16 $\mu$m.

The following experiments were conducted to evaluate the development efficiency of the toner over a wide range of bias voltages. The having a mean diameter particle size of 16 $\mu$m (see FIG. 6 for a typical diameter particle size distribution for toner) was combined with silica particles and subjected to bias voltages ranging from approximately 100 V to 800 V (DC). The experiments were conducted in accordance with the meters appearing in Table 2 below:

TABLE 2

| Exp. No. | small silica size (nm) | large silica size (nm) | % by wt. small silica | % by wt. large silica | T/RH (° F./%) | Q/M ($\mu$C/g) |
|---|---|---|---|---|---|---|
| 1 | 10 | 40 | 0.3 | 0.4 | 73/53 | 7.5 |
| 2 | 10 | 40 | 0.7 | 0.4 | 70/55 | 5.0 |
| 3 | 10 | 40 | 0.9 | 0.4 | 71/60 | 5.6 |
| 4 | 10 | 40 | 1.1 | 0.4 | 73/53 | 6.6 |
| 5 | 10 | 40 | 0.7 | 0.2 | 74/57 | 5.7 |
| 6 | 10 | 40 | 0.7 | 0.6 | 73/54 | 5.8 |

The silica particle size depicted in Table 2 corresponds to the mean diameter of the silica particles having a size distribution (see FIG. 5).

The development efficiency, which is shown as a percentage in FIGS. 7 through 13, was measured as the ratio of the mass per unit area of the developed toner transferred to the surface of the photoreceptor to the combined mass per unit area of the developed toner and the residual toner carried on the toner support member following the development process. Alternatively, the development efficiency may be measured as the ratio of the mass per unit area of the developed toner transferred to the surface of the photoreceptor to the mass per unit area of the toner carried on the toner support member prior to development.

The toner support member and image-bearing surface were positioned in spaced relation in accordance with the prescribed gap discussed above and rotated at the same speed. After a prescribed voltage was applied, the mass per unit area of the toner particles that jumped the gap and adhered to the image-bearing surface was measured by aspirating a portion of toner layer from the surface of the photoreceptor, weighing the aspirated toner, measuring the aspirated area, and then dividing the weight of the aspirated toner by the aspirated area. The mass per unit area of the residual toner left on the toner support member was measured in the same fashion. The development efficiency was preferably calculated as follows:

$$\text{Efficiency}=\frac{\text{Developed Mass Per Unit Area}}{(\text{Developed Mass Per Unit Area}+\text{Residual Mass Per Unit Area})}$$

These steps were carried out for each prescribed bias voltage for each tested toner.

Figure 7:
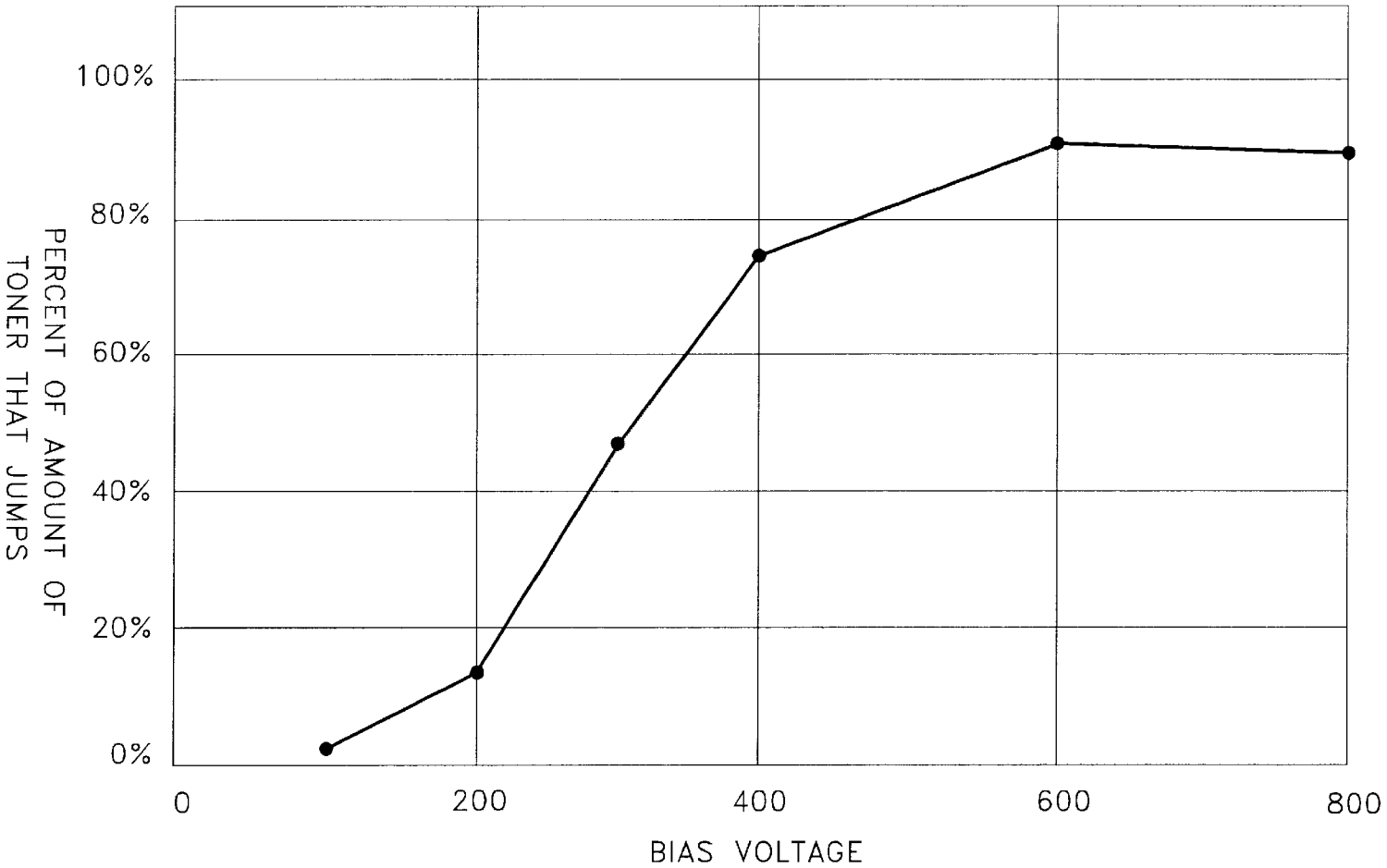
FIG. 7 is a graph showing development efficiency.
Figure 8:
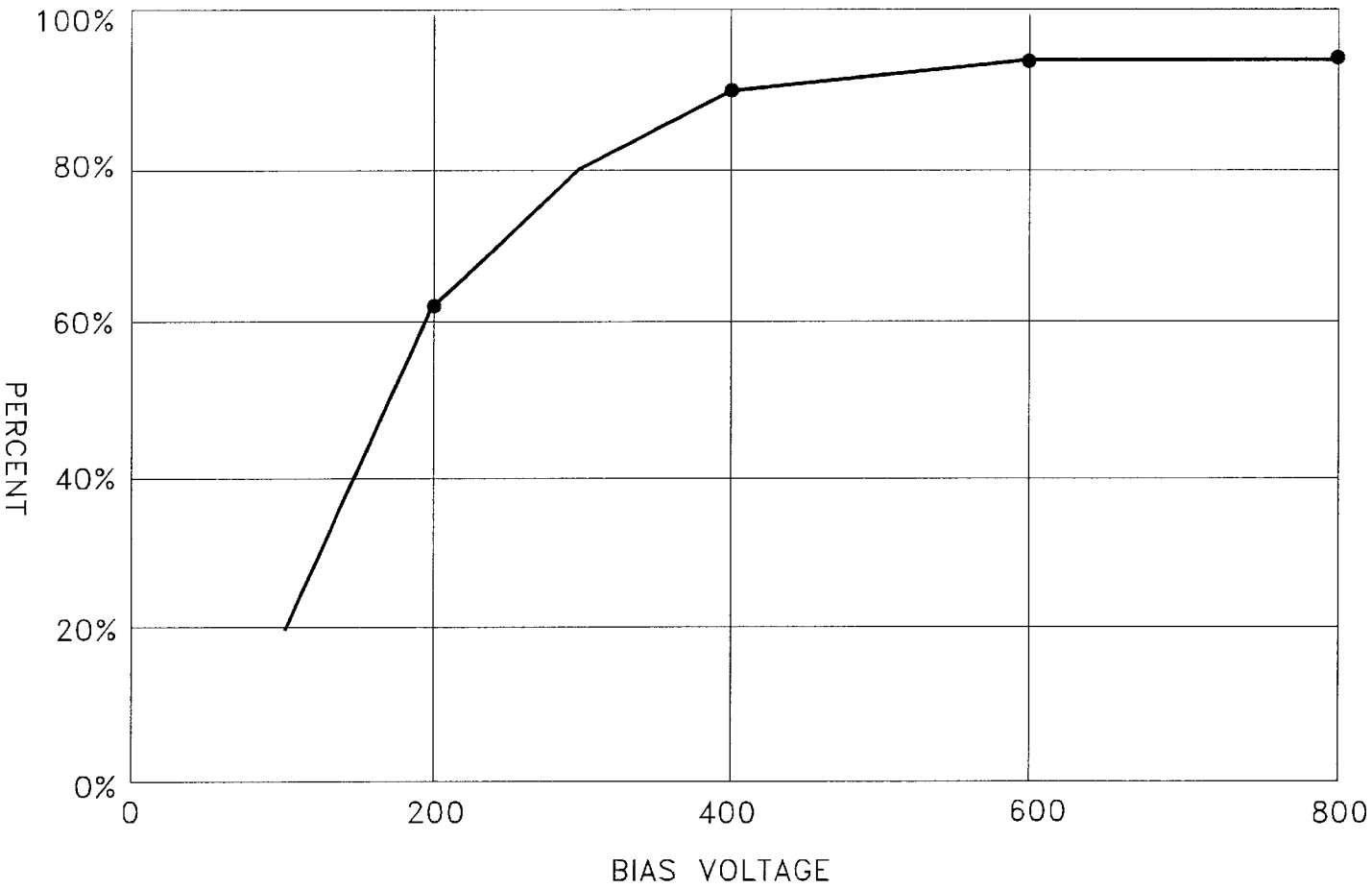
FIG. 8 is a graph showing development efficiency.

The results of experiments 1 through 6 (shown in Table 2) appear in FIGS. 7 through 12, respectively, as graphs wherein the percentage development efficiency is plotted against the applied bias voltage. As shown in FIG. 8, the silica concentration of 0.4 percent by weight of large silica and 0.7 percent by weight of small silica resulted in the highest and most consistent development efficiency over a wide range of bias voltages. More particularly, this concentration resulted in over 90 percent development efficiency, i.e., development efficiency in a range of about 90 to 98 percent, when the toner support member was subjected to bias voltages ranging from 400 V (DC) to 800 V (DC).

Figure 9:
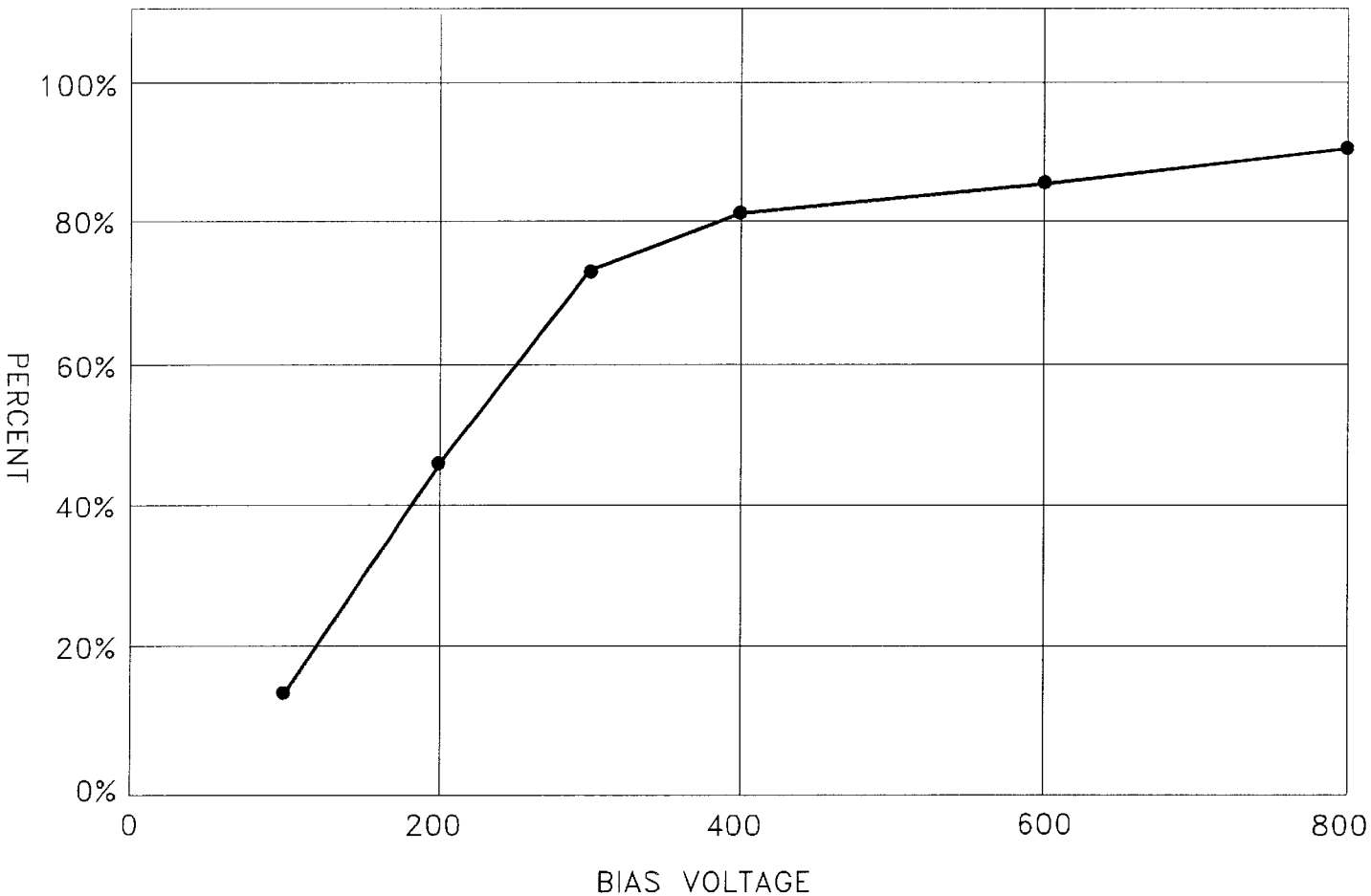
FIG. 9 is a graph showing development efficiency.
Figure 10:
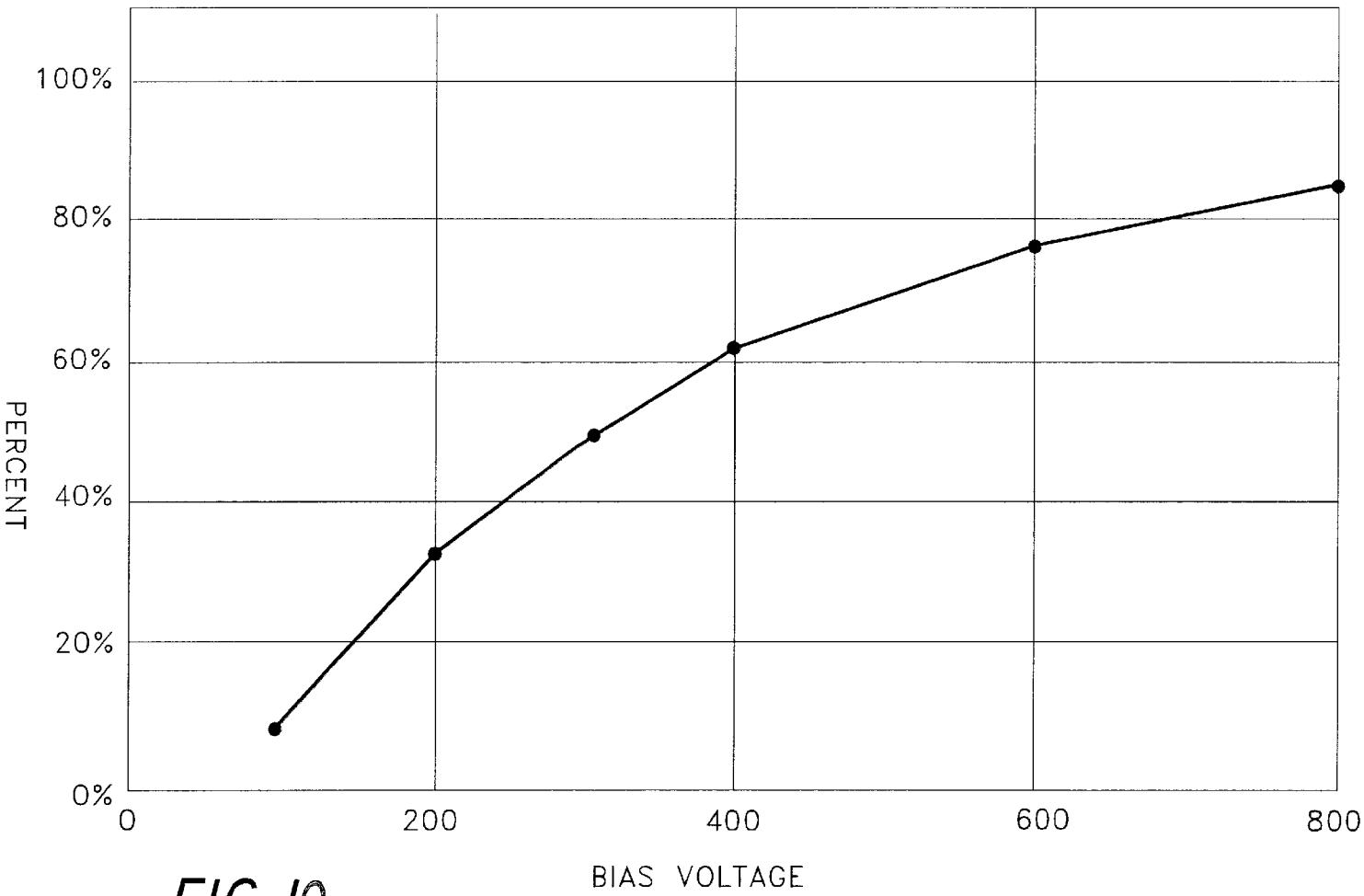
FIG. 10 is a graph showing development efficiency.
Figure 11:
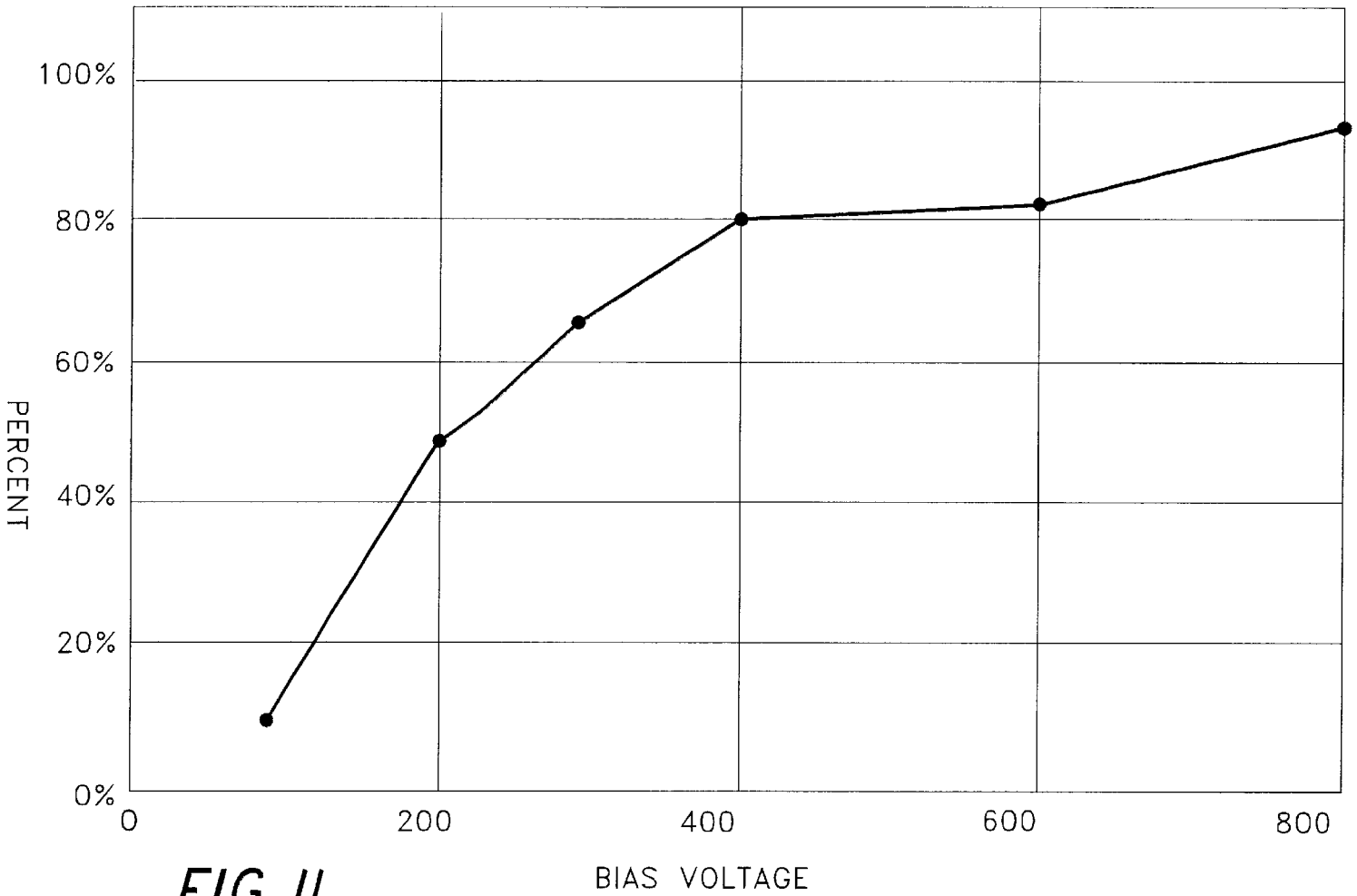
FIG. 11 is a graph showing development efficiency.
Figure 12:
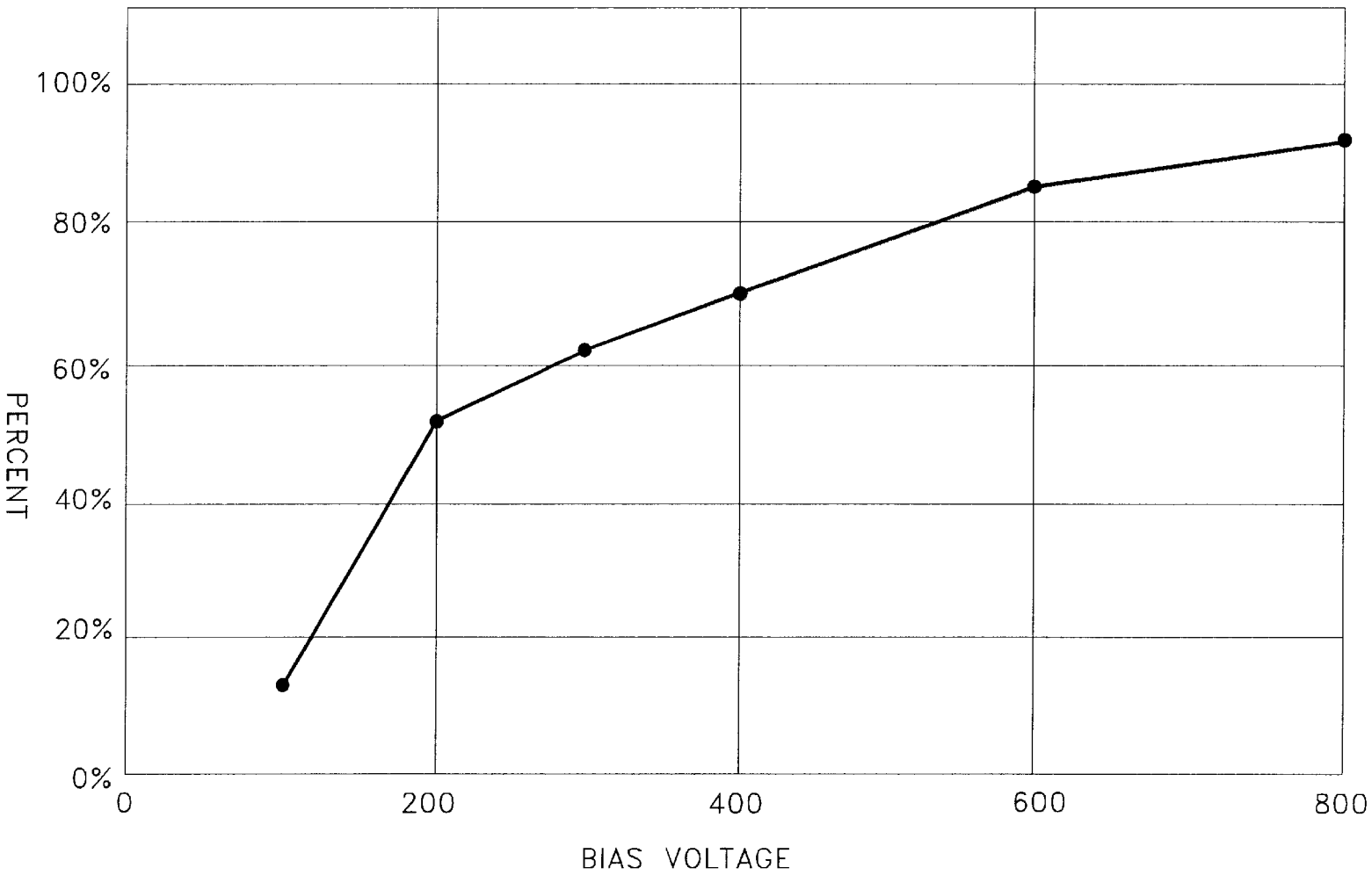
FIG. 12 is a graph showing development efficiency.

As shown in FIGS. 7, 9, and 10, the development efficiency tends to decrease as the concentration by weight of small silica particles increases or decreases from 0.7 percent by weight. Similarly, as shown in FIGS. 11 and 12, the development efficiency also tends to decrease as the concentration by weight of large silica particles increases or decreases from 0.4 percent by weight.

Those of skill in the art will appreciate that by adhering to the surface coverage values for extraparticulate particles provided herein, the optimum concentration by weight of extraparticulate particles can be determined for a variety of silica and toner particle sizes (e.g., toner particles in a range of about 6 to 24 $\mu$m). For example, the calculated silica concentrations for a toner having a mean diameter particle size of 12 $\mu$m, and small and large silica having mean diameter particle sizes of 10 and 40 nm, are 0.5 percent and 0.9 percent respectively.

Figure 13:
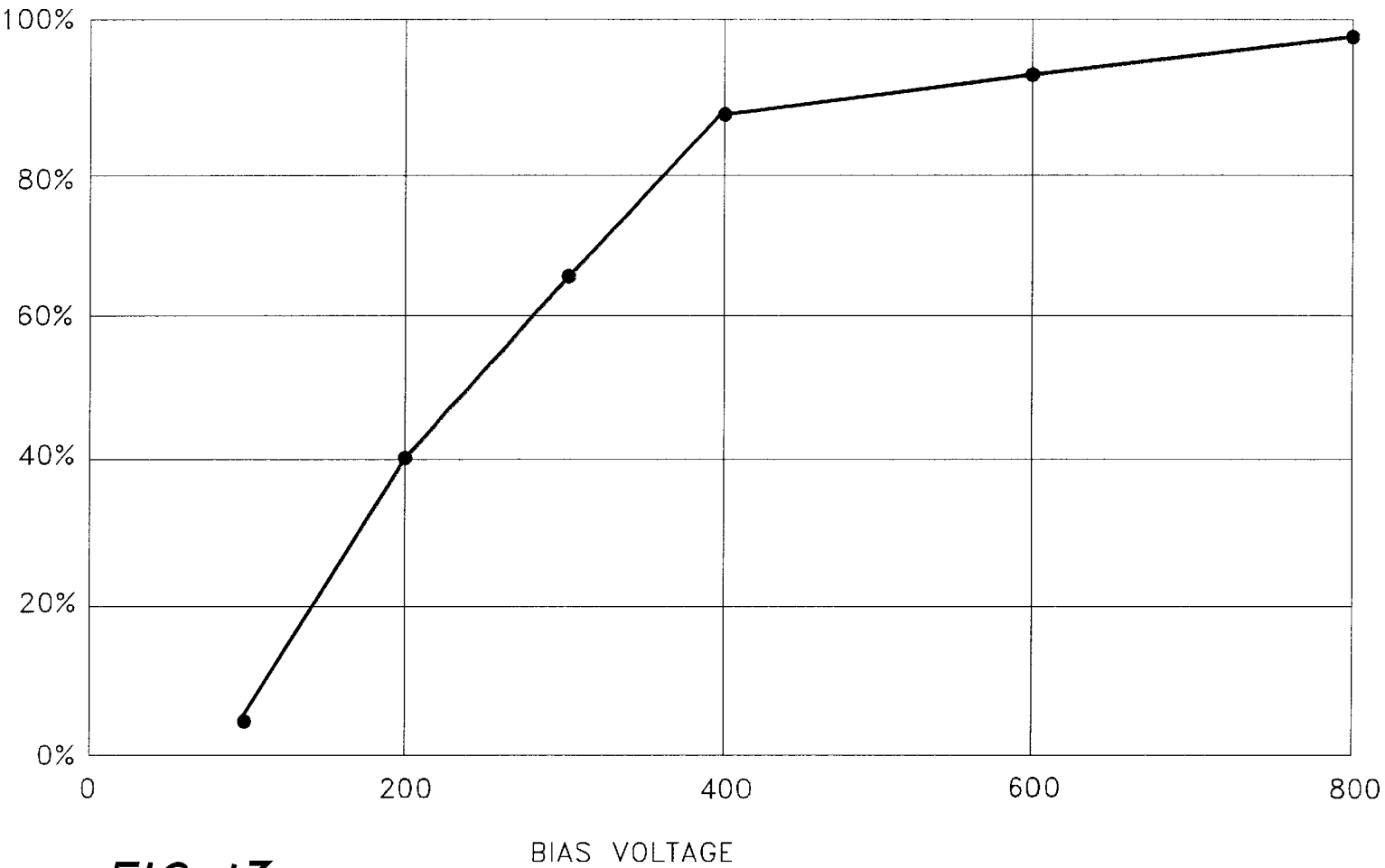
FIG. 13 is a graph showing development efficiency.

A toner comprising toner particles having a mean diameter particle size of 12 $\mu$m was tested in accordance with the procedure described above to determine its development efficiency across a wide range of bias voltages. The test parameters included small and large silica particles having mean diameters of 10 and 40 nm, respectively, a mean Q/M value of 5.86 $\mu$C/g, as measured by the Torrey Pines Research's aspirator, for the toner and environmental conditions of 75° F. and 52 percent RH. As shown in FIG. 13, the development efficiency of this toner was comparable to the development efficiency of the toner having a mean diameter particle size of 16 Am shown in FIG. 9. The development efficiency ranges from nearly 90 percent to nearly 99 percent over a range of applied bias voltages of approximately 400 V (DC) to 800 V (DC). As indicated above, these efficiencies tend to insure the consistent production of high quality images over a wide range of bias voltages.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A non-contact, single-component developing system comprising:

a photoreceptor capable of having an electrostatic latent image recorded thereon; and a toner support member disposed in opposing relationship with the photoreceptor with a gap therebetween defining a developing region, the toner support member adapted to carry a toner thereon to the developing region;

wherein the developing region is without AC voltage and wherein the toner comprises toner mixed with large and small extraparticulate particles, a weight concentration of small extraparticlate particles resulting in a first surface coverage of the toner in a range of about 50 to 150 percent and a weight concentration of large extraparticulate particles resulting in a second surface coverage of the toner in a range of about 5 to 50 percent.

2. The developing system of claim 1 wherein the toner has a mean diameter particle size by volume in a range of about 5 to 20 $\mu$m.

3. The developing system of claim 1 wherein the extraparticulate is formed from silica.

4. The developing system of claim 3 wherein the toner includes small silica having a mean diameter particle size in a range of about 6 nm to 14 nm.

5. The developing system of claim 3 wherein the toner includes large silica having a mean diameter particle size in a range of about 20 nm to 60 nm.

6. The developing system of claim 1 wherein the gap between the image bearing member and the toner support member is 75 to 250 $\mu$m.

7. The developing system of claim 1 comprising a charge source electrically coupled to the photoreceptor and a light source.

8. The developing system of claim 7 wherein the charge source comprises a plurality of charger elements and the light source comprises a plurality of light emitting diodes (LED), and wherein the toner support member comprises a plurality of toner supports.

9. The developing system of claim 8 wherein the plurality of light sources comprises four LED arrays, the plurality of charger elements comprises four charger elements, and the plurality of toner support members comprise four toner support members.

10. The developing system of claim 9 wherein the toner comprises first, second, third and fourth color toners.

11. An electrophotographic machine comprising a developing system as described in claim 1, the developing system being adapted to jump develop an image without applying AC voltage.

12. An electrophotographic machine comprising a plurality of developing systems as described in claim 1, each of the plurality of developing systems adapted to develop a different color toner image.

13. The electrophotographic machine of claim 12 adapted to jump develop an image without applying AC voltage.

14. The electrophotographic machine of claim 13 adapted to develop a composite color image comprising each different color toner image without transferring each developed color toner image to an accumulator.

15. The electrophotographic machine of claim 14 adapted to develop a developed image on a photoreceptor in a single cycle of the photoreceptor, the developed image comprising toner of four distinct colors.

16. The developing system of claim 1, wherein the efficiency of toner transfer from the toner support member to a latent image formed on the image bearing member is greater than 80 percent.

17. A single component toner comprising a plurality of toner particles;

a first plurality of extraparticulate particles; and a second plurality of extaparticulate particles;

wherein the first and second plurality of extraparticulate particles are mixed with the plurality of toner particles at a concentration of first plurality of extraparticulate particles resulting in a first surface coverage of the plurality of toner particles in a range of about 50 to 150 percent and a concentration of second plurality of extraparticulate particles resulting in a second surface coverage of the plurality of toner particles in a range of about 5 to 50 percent such that said single component toner is capable of working in a non-contact developing system having a developing region without AC voltage.

18. The toner of claim 17 wherein the extraparticulate is formed from silica.

19. The toner of claim 17 wherein the plurality of toner particles having a mean diameter size by volume in a range of about 5 to 20 $\mu$m.

20. The developing system of claim 18 wherein the first plurality of silica particles having a mean diameter size in a range of about 6 nm to 14 nm.

21. The developing system of claim 20 wherein the second plurality of silica particles having a mean diameter particle size in a range of about 20 nm to 60 nm.

22. A non-contact single pass electrophotographic imaging process comprising the steps of creating a latent image on a surface of a photoreceptor, and developing the latent image into a developed image by forcing toner particles across a gap between a toner support member and the photoreceptor without AC voltage.

23. The imaging process of claim 22 wherein the toner is comprising a plurality of toner particles;

a first plurality of extraparticulate particles; and a second plurality of extraparticulate particles;

wherein the first and second plurality of extraparticulate particles are mixed with the plurality of toner particles at a concentration of first plurality of extraparticulate particles resulting in a first surface coverage of the plurality of toner particles in a range of about 50 to 150 percent and a concentration of second plurality of extraparticulate particles resulting in a second surface coverage of the plurality of toner particles in a range of about 5 to 50 percent.

24. The imaging process of claim 23 wherein the extraparticulate is formed from silica.

25. The imaging process of claim 24 wherein the plurality of toner particles having a mean diameter size in a range of about 5 to 20 $\mu$m.

26. The imaging process of claim 25 wherein the first plurality of silica particles having a mean diameter size in a range of about 6 nm to 14 nm.

27. The imaging process of claim 26 wherein the second plurality of silica particles having a mean diameter particle size in a range of about 20 nm to 60 nm.

* * * * *